US012779291B2

(12) United States Patent
Sieradzki

(10) Patent No.: US 12,779,291 B2
(45) Date of Patent: Nov. 3, 2026

(54) GOLF CLUB FERRULE WRAP

(71) Applicant: Black Swan Golf LLC, Bellevue, WA (US)

(72) Inventor: Jeffrey R. Sieradzki, Gig Harbor, WA (US)

(73) Assignee: BLACK SWAN GOLF LLC, Bellevue, WA (US)

( * ) Notice: Subject to any disclaimer, the term of this patent is extended or adjusted under 35 U.S.C. 154(b) by 697 days.

(21) Appl. No.: 18/306,630

(22) Filed: Apr. 25, 2023

(65) Prior Publication Data

US 2023/0347212 A1 Nov. 2, 2023

Related U.S. Application Data

(60) Provisional application No. 63/363,664, filed on Apr. 27, 2022.

(51) Int. Cl.
*A63B 53/02* (2015.01)
*A63B 53/08* (2015.01)

(52) U.S. Cl.
CPC ..... *A63B 53/02* (2013.01); *A63B 53/08* (2013.01); *A63B 2209/10* (2013.01); *A63B 2225/54* (2013.01)

(58) Field of Classification Search
CPC ..... A63B 53/02; A63B 53/08; A63B 2209/10; A63B 2225/54; A63B 69/3638; A63B 2071/0694; A63B 2209/00; A63B 2225/15; A63B 60/02; A63B 60/42; A63B 60/14; A63B 60/16; A63B 60/54; A63B 71/0054; A63B 2053/0491; G09F 23/0066; G06K 19/06037; G06K 19/0723
USPC ..... 473/308
See application file for complete search history.

(56) References Cited

U.S. PATENT DOCUMENTS

| | | | | |
|---|---|---|---|---|
| 2,608,409 | A | 8/1952 | Pinkerton | |
| 3,877,426 | A * | 4/1975 | Nirschl | A61F 13/108 473/212 |
| 4,045,034 | A * | 8/1977 | Thomas | A63B 21/0603 473/282 |
| 4,538,812 | A | 9/1985 | Mugford et al. | |
| 5,711,721 | A | 1/1998 | Johnson et al. | |
| 6,419,591 | B1 | 7/2002 | Addeo et al. | |
| 8,124,205 | B2 | 2/2012 | Watanabe | |
| 8,480,511 | B2 | 7/2013 | Sargent et al. | |
| 8,678,946 | B2 | 3/2014 | Boyd et al. | |

(Continued)

FOREIGN PATENT DOCUMENTS

| | | |
|---|---|---|
| AU | 366147 S | 12/2015 |
| CA | 2773215 C | 10/2013 |

(Continued)

*Primary Examiner* — Yingchuan Zhang
(74) *Attorney, Agent, or Firm* — Michael E. Dockins; Shumaker, Loop & Kendrick, LLP

(57) ABSTRACT

A wrap configured for application to a ferrule of a golf club includes a flexible sheet defining an outer major surface and an inner major surface disposed opposite thereto. The outer major surface displays a graphic thereon and the inner major surface is configured to be adhered to an outer surface of the ferrule when the wrap is applied to the ferrule. The wrap is configured to protect the ferrule, secure the ferrule to the golf club, provide a desired appearance thereof, and optionally to track or identify the golf club to which the wrap is applied.

20 Claims, 5 Drawing Sheets

(56) References Cited

U.S. PATENT DOCUMENTS

| | | | | |
|---|---|---|---|---|
| D740,382 | S | 10/2015 | Koo et al. | |
| D758,514 | S | 6/2016 | Mandel et al. | |
| 10,152,720 | B2 | 12/2018 | Mandel et al. | |
| 2003/0104877 | A1* | 6/2003 | Shiraishi | A63B 60/46 473/287 |
| 2006/0252573 | A1 | 11/2006 | Fenimore et al. | |
| 2007/0240799 | A1* | 10/2007 | Hansen | A63B 53/12 473/316 |
| 2008/0152852 | A1 | 6/2008 | Watanabe | |
| 2008/0153622 | A1 | 6/2008 | Watanabe | |
| 2013/0017901 | A1 | 1/2013 | Sargent et al. | |
| 2013/0230654 | A1 | 9/2013 | Sargent et al. | |
| 2016/0166902 | A1* | 6/2016 | Day | A63B 60/16 473/223 |
| 2016/0296810 | A1 | 10/2016 | Mandel et al. | |
| 2017/0333768 | A1 | 11/2017 | Mandel et al. | |
| 2019/0344139 | A1 | 11/2019 | Amarant et al. | |

FOREIGN PATENT DOCUMENTS

| | | | | | |
|---|---|---|---|---|---|
| CA | 164783 | S | | 5/2016 | |
| GB | 2520242 | A | | 5/2015 | |
| JP | 2007143904 | A | | 6/2007 | |
| JP | 2008154622 | A | | 7/2008 | |
| JP | 2008154623 | A | | 7/2008 | |
| JP | 1548792 | S | | 5/2016 | |
| KR | 20080058151 | A | | 6/2008 | |
| KR | 20080058154 | A | | 6/2008 | |
| KR | 20140040211 | A | | 4/2014 | |
| KR | 20210117710 | A | * | 9/2021 | B29C 43/56 |
| KR | 102307747 | B1 | | 10/2021 | |
| WO | 8501219 | A1 | | 3/1985 | |

* cited by examiner

GOLF CLUB FERRULE WRAP

CROSS-REFERENCE TO RELATED APPLICATION

This patent application claims priority to U.S. Provisional Patent Application Ser. No. 63/363,664, filed on Apr. 27, 2022, the entire disclosure of which is hereby incorporated herein by reference.

FIELD OF THE INVENTION

The present invention generally relates to the field of sports equipment and accessories, and more particularly, to a removable wrap configured for application to the ferrule of a golf club.

BACKGROUND

A golf club ferrule is an ornamental piece added to the golf club to smooth the transition from the irregularly shaped golf club head to the cylindrical golf club shaft. Golfers have the ability to customize their golf clubs with different ferrules, including the selection of different colors, sizes, and shapes to present a desired ornamental appearance to the golf club.

Unfortunately, the current processes utilized in forming and assembling such ferrules do not necessarily facilitate the ease of such golf club customization. For example, it may be necessary for the corresponding golf club to be dismantled to change or customize the ferrule thereof. The dismantling and reassembly of the golf club can alter many functional aspects thereof, such as altering loft and lie angles, which can lead to the avoidance of such potentially negative customization processes.

As another example, golf club ferrules are difficult to secure properly to the golf club shaft, and especially for a long period of time. The installation of the ferrule may include the use of an epoxy for forming a bond between the ferrule and the engaging portions of the head and the shaft of the golf club, but such an epoxy-based bond may be weak or easily compromised, thereby allowing the ferrule to move in position relative to the head and the shaft following the replacement thereof. Such a method of installing the ferrule to the golf club may accordingly result in an undesirable appearance of the golf club following such undesirable movement.

There is also an inherent concern associated with the tolerances utilized in manufacturing the ferrule for installation relative to the shaft and a hosel of the golf club. In some circumstances, the ferrule may not be manufactured to easily match the corresponding surfaces of the shaft and the hosel, hence material may need to be removed to properly fit the ferrule to the golf club. This can be a time consuming and imprecise process when the ferrule is being replaced for the purposes of customization.

The ferrule is also exposed at a position on the golf club where damage to the ferrule is possible, such as when striking a hard object during a high-speed golf swing, or when the golf club is exposed to potentially damaging environmental factors. Any such damage to the exposed ferrule is thus visually perceptible following such an occurrence, thereby negatively affecting the customized appearance of the ferrule. Environmental damage may also compromise the junction of the hosel, the ferrule, and the shaft, thereby negatively affecting both the appearance and operational use thereof.

There is accordingly a need for an alternative method of customizing the appearance of the golf club at the junction of the hosel and the shaft thereof that does not involve the replacement and/or installation of a customized or modified ferrule.

It is also desirable in some circumstances to customize a golf club via the introduction of additional weight to the golf club at a desired location. However, there are currently limited options in adding such weight to a golf club, such as limits to the positions on the golf club where such weight can be easily secured thereto, or limits to how easily the weights may be substantially replaced or repositioned.

It would accordingly also be beneficial to provide a method of customizing the operational characteristics of the golf club at the junction of the hosel and the shaft that again does not require the replacement and/or installation of a customized or modified ferrule.

The customization of a golf club may also include the addition of identifying information to a portion of the golf club. For example, it may be desirable for information regarding the unique specifications of the golf club to be accessible to the user thereof, such as when determining which club to utilize for a specific circumstance. As another example, it is common for individual clubs or whole sets to be misplaced or otherwise lost during use thereof such that it would be beneficial to identify the golf club and the user/owner thereof via inspection thereof, thereby facilitating the ability to easily identify and return such lost clubs or sets.

It would therefore be desirable for the customization of such golf clubs to further include the ability to display information about the golf club and/or the owner/user thereof in real time via the addition of an information display feature or tracking feature.

SUMMARY OF THE INVENTION

The following presents a summary of certain embodiments of the invention. This summary is not intended to identify key or critical elements of all embodiments nor delineate the scope of any or all embodiments. Its sole purpose is to present certain concepts and elements of one or more embodiments in a summary form as a prelude to the more detailed description that follows.

Embodiments of the present invention address the above needs and/or achieve other advantages by providing a novel golf ferrule wrap. According to one embodiment of the present invention, wrap configured for application to a ferrule of a golf club includes a flexible sheet defining an outer major surface and an inner major surface disposed opposite thereto. The outer major surface displays a graphic thereon and the inner major surface is configured to be adhered to an outer surface of the ferrule when the wrap is applied thereto.

According to another embodiment, a golf club assembly includes a golf club having a hosel receiving a shaft therein and a ferrule disposed at a junction of the hosel and the shaft. A wrap is configured for application to the ferrule of the golf club. The wrap includes a flexible sheet defining an outer major surface and an inner major surface disposed opposite thereto. The outer major surface displays a graphic thereon and the inner major surface is configured to be adhered to an outer surface of the ferrule when the wrap is applied thereto.

The features, functions, and advantages that have been discussed may be achieved independently in various embodiments of the present invention or may be combined with yet other embodiments, further details of which can be seen with reference to the following description and drawings.

BRIEF DESCRIPTION OF THE DRAWINGS

Figure 1:
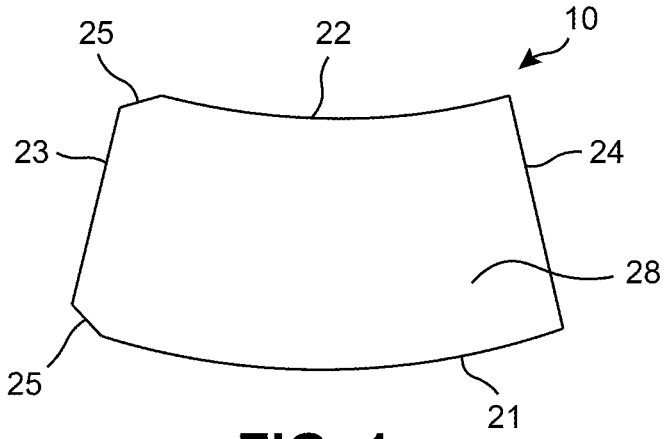
Figure 2:
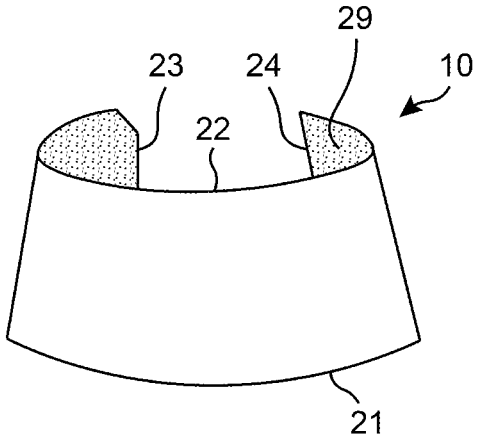
Figure 3:
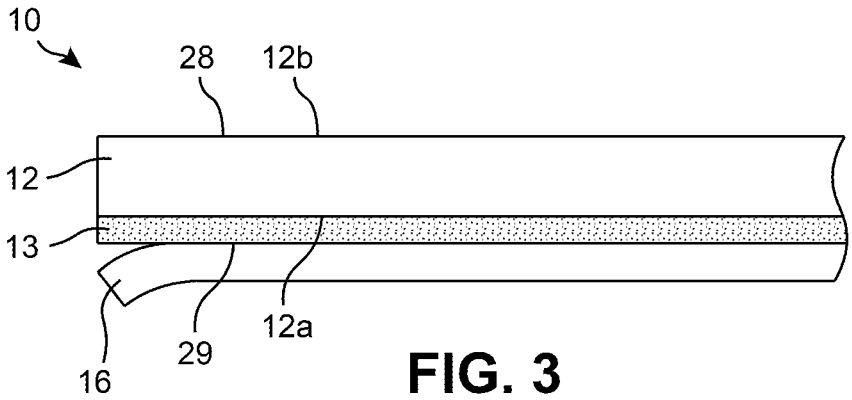
Figure 4:
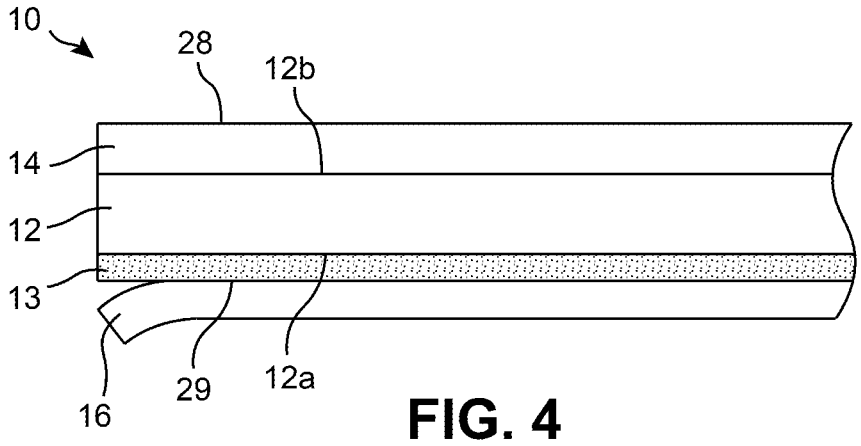
Figure 5:
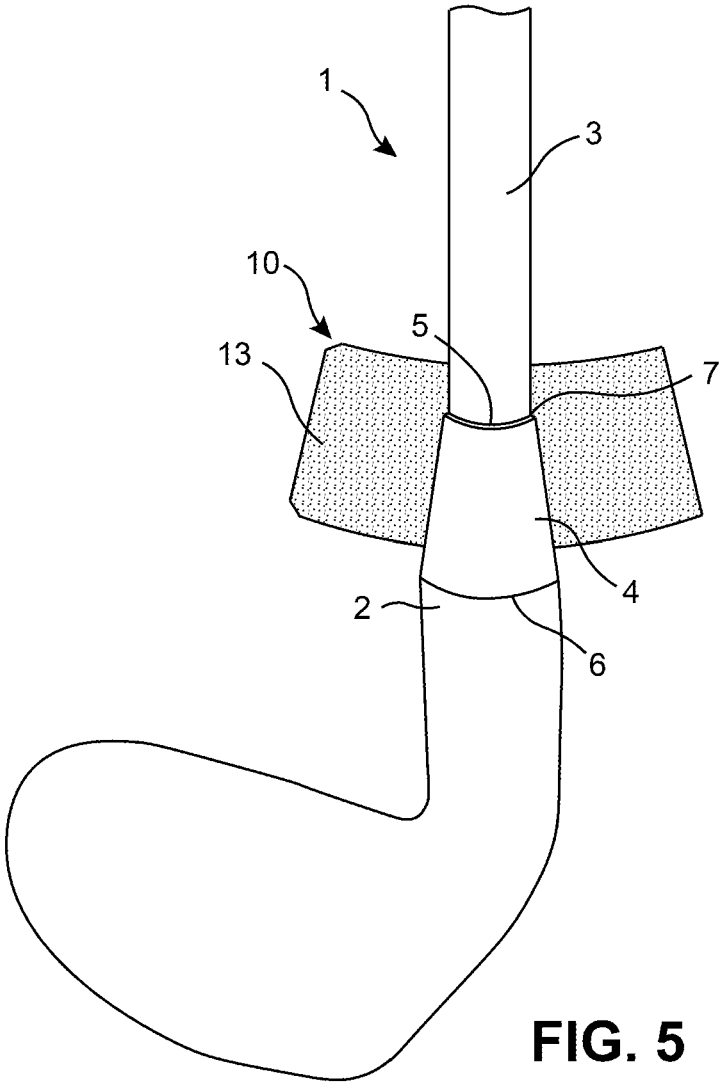
Figure 6:
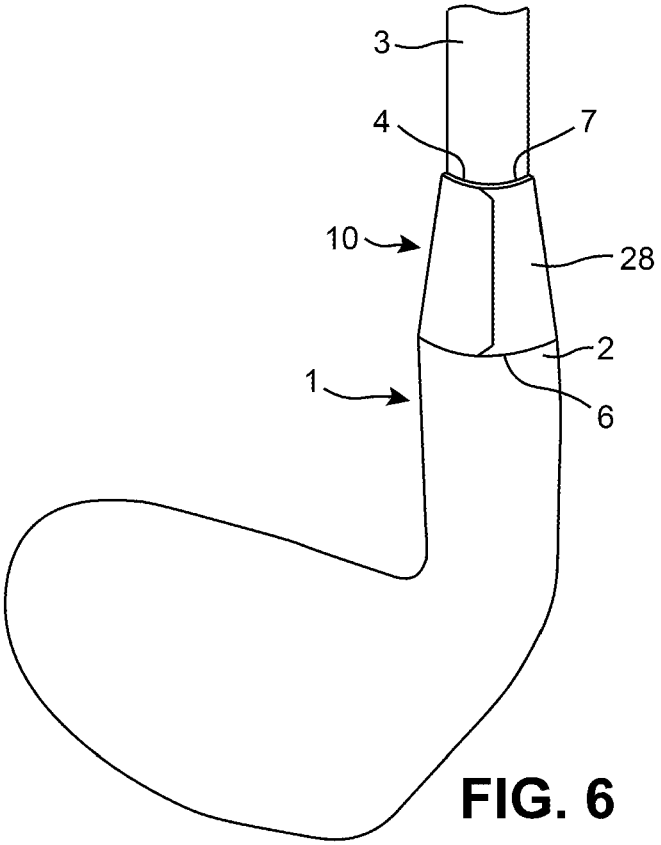
Figure 7:
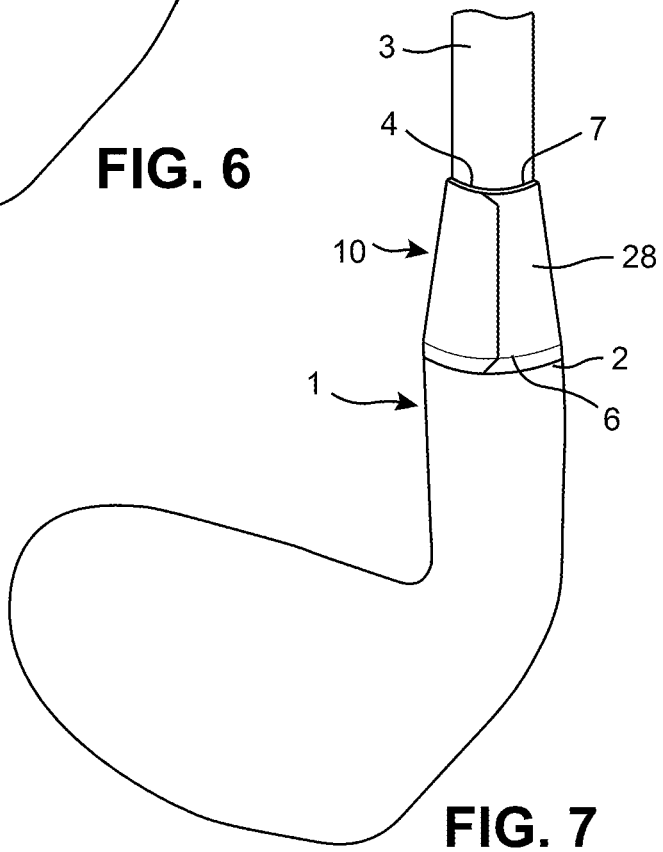
Figure 8:
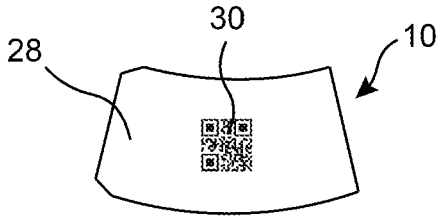
Figure 9:
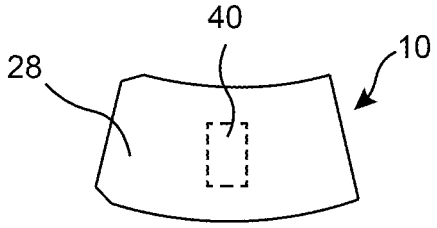
Figure 10:
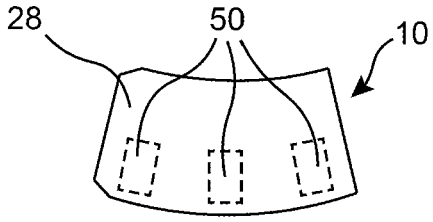
Figure 11:
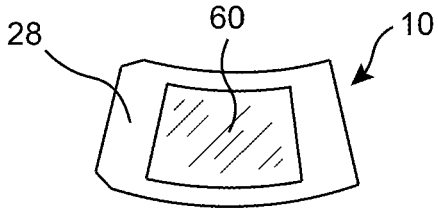

Having thus described embodiments of the invention in general terms, reference will now be made the accompanying drawings, wherein:

FIG. 1 is an elevational front view of a golf ferrule wrap when laid out two-dimensionally according to an embodiment of the present invention;

FIG. 2 is a perspective front view showing the golf ferrule wrap of FIG. 1 after being flexed into a substantially frustoconical three-dimensional shape;

FIG. 3 is a side elevational view showing the layers comprising the golf ferrule wrap according to an embodiment of the present invention;

FIG. 4 is a side elevational view showing the layers comprising the golf ferrule wrap according to another embodiment of the present invention;

FIG. 5 is a perspective front view showing the golf ferrule wrap adjacent a golf club prior to application of the golf ferrule wrap thereto;

FIG. 6 is a perspective front view showing the golf ferrule wrap as extending exclusively around an outer surface of a ferrule of the golf club following application to the golf club according to one implementation of the present invention;

FIG. 7 is perspective front view showing the golf ferrule wrap as extending around the ferrule and an end portion of a hosel of the golf club following application to the golf club according to another implementation of the present invention;

FIG. 8 is a front elevational view showing the golf ferrule wrap as having an optical code displayed on an exposed outer surface thereof according to an embodiment of the present invention;

FIG. 9 is a front elevational view showing the golf ferrule wrap as having an RFID tag coupled thereto according to an embodiment of the present invention;

FIG. 10 is a front elevational view showing the golf ferrule wrap as having a plurality of weights coupled thereto according to an embodiment of the present invention; and FIG. 11 is a front elevational view showing the golf ferrule wrap as having a visual tracking feature, such as a reflective surface, displayed on an exposed outer surface thereof according to an embodiment of the present invention.

DETAILED DESCRIPTION OF EMBODIMENTS OF THE INVENTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIGS. 1-11 disclose a golf ferrule wrap 10 configured for application to an outer surface of a corresponding golf club 1. With reference to FIG. 5, the golf club 1 suitable for use with the wrap 10 may include a hosel 2, a shaft 3 received within an opening of the hosel 2, and a ferrule 4 disposed around the shaft 3 at an end of the hosel 2 having the opening (not shown) formed therein. The shaft 3 and the opening formed in the hosel 2 are each substantially cylindrical in shape to closely receive the shaft 3 within the opening of the hosel 2. The hosel 2 may include a substantially cylindrical shape at or adjacent the end of the hosel 2 having the opening formed therein. The ferrule 4 is provided to be substantially frustoconical in shape when extending from the end of the hosel 2 to a position along the shaft 3 spaced apart from the end of the hosel 2 in an axial direction of the shaft 3. The ferrule 4 includes a cylindrical opening 5 formed axially therethrough for receiving the axially extending portion of the shaft 3 disposed adjacent the hosel 2 therethrough.

The frustoconically shaped ferrule 4 includes a first axial end 6 configured to abut the end of the hosel 2 and a second axial end 7 spaced apart from the first axial end 6 with respect to the axial direction of the shaft 3. The first axial end 6 includes an outer surface of the ferrule 4 having a first diameter substantially equal to the diameter of the outer surface of the hosel 2 along a perimeter of the end thereof to result in a substantially smooth transition from the outer surface of the ferrule 4 to the outer surface of the hosel 2 at the junction therebetween. However, it should be understood that the present invention may be utilized in circumstances wherein the diameters do not match perfectly, thereby resulting in the first axial end 6 either protruding slightly outwardly relative to the circumferential surface of the hosel 2 or being indented slightly inwardly relative thereto, as the wrap 10 can extend over such a junction, when desired. The second axial end 7 includes an outer surface of the ferrule 4 having a second diameter that is less than the first diameter, wherein the second diameter is substantially equal to or slightly greater than a diameter of the shaft 3 at the axial position of the second axial end 7. A slight shoulder may be present along the outer surface of the golf club 1 where the ferrule 4 protrudes outwardly from the shaft 3 at the second axial end 7. An axial distance present between the axial ends 6, 7 may be selected to result in the ferrule 4 having a desired slope between the axial ends 6, 7 and relative to a central axis of the shaft 3 for providing a desired appearance of the ferrule 4 when transitioning the outer surface of the hosel 2 to an outer surface of the shaft 3.

The wrap 10 may be comprised of a plurality of different layers coupled to one another. As shown in FIG. 3, the wrap 10 may comprise at least one base layer 12 and an adhesive layer 13. The base layer 12 includes a first major surface 12*a* and an opposing second major surface 12*b*, which are spaced from each other with respect to a thickness direction of the wrap 10. The adhesive layer 13 is coated on the first major surface 12*a* and may be formed from any suitable adhesive having suitable adhesiveness for affixing the wrap 10 to the gold club 1 in a manner preventing undesired removal of the wrap 10 from the outer surface of the gold club 1. The second major surface 12*b* may form an exposed surface of the wrap 10 that is visually perceptible when the wrap 10 is disposed around the ferrule 4 of the golf club 1.

The wrap 10 may further include a backing layer 16 removably coupled to the adhesive layer 13. The backing layer 16 may be formed from a sheet of any material configured to be removably coupled to the adhesive layer 13 in a desired manner. For example, the backing layer 16 may be adhered to the adhesive layer 13 in a manner wherein the backing layer 16 may be removed from the adhesive layer 13 via manual pulling of the backing layer 16 away from the adhesive layer 13, such as peeling of the backing layer 16 from an edge of the wrap 10, while the adhesive layer 13 maintains the desired adhesive properties thereof for coupling the wrap 10 to the outer surface of the gold club 1 following the removal of the backing layer 16.

In some embodiments, as shown in FIG. 4, the wrap 10 may include each of the base layer 12 and an additional cover layer 14 disposed adjacent the second major surface 12*b* of the base layer 12 opposite the adhesive layer 13 and backing layer 16. The cover layer 14 may be provided for a variety of different reasons, depending on the application for which the wrap 10 is utilized. In some embodiments, the cover layer 14 is provided to allow for the capturing of a secondary component within the wrap 10, such as is disclosed with reference to the embodiments of the wrap 10 shown in FIGS. 9 and 10, which are elaborated on hereinafter. In other embodiments, the cover layer 14 may be provided when it is desired to prescribe a desired outward appearance of the wrap 10 that is not consistent with the use of the base layer 12 as the exposed outer layer. For example, there may be circumstances where the exposed outer surface of the wrap 10 formed by the cover layer 14 is provided to include a particular surface finish or the like for prescribing a specific appearance of the wrap 10 that is not consistent with the use of the base layer 12 as the outer exposed surface. Such an example may include the base layer 12 being selected to include characteristics lending towards a desired strength and/or durability of the wrap 10 in resisting tearing, deformation, or environmental degradation, and the exposed cover layer 14 being selected to prescribe a desired outward appearance of the wrap 10 for ensuring that the wrap 10 has a desirable ornamental appearance, such as having a glossy or matte finish. In yet other embodiments, the graphics disposed on the wrap 10 may be printed or otherwise received/disposed on the base layer 12 while the cover layer 14 may be disposed over the base layer 12 and provided with a suitable transparency for exposing the graphics of the underlying base layer 12. The base layer 12 may also be provided as a plurality of distinct layers of differing materials and/or thicknesses to result in the wrap 10 having desired characteristics resulting from the stacking and/or lamination of such layers.

The wrap 10 may accordingly be said to include an outer exposed major surface 28 formed opposite an inner adhesive major surface 29 when the wrap 10 is ready for application to the ferrule 4 (following removal of the backing layer 16). The outer exposed major surface 28 may refer to either of the outer disposed surface of the base layer 12 or the cover layer 14 and the inner adhesive major surface 29 may refer to the inner disposed surface of the adhesive layer 13. The outer exposed major surface 28 forms the visually perceptible surface of the wrap 10 once coupled (adhered) to the outer surface of the ferrule 4 and may accordingly represent the surface of the wrap 10 portraying an ornamental appearance thereof.

Regardless of the number of layers utilized, each of the layers 12, 13, 14, 16 forming the wrap 10 is provided to have sufficient flexibility to allow the wrap 10 to be deformed to a three-dimensional configuration corresponding to the frustonical shape of the outer surface of the ferrule 4 for closely fitting the wrap 10 around the ferrule 4. The flexibility of the wrap 10 refers to the ability of the wrap 10 to bend or flex from a planar configuration to a curved or arcuate configuration offset from the planar configuration at any position along the opposing major surfaces 28, 29 of the wrap 10. Suitable materials for forming the base layer 12, the cover layer 14, or the backing layer 16 for providing such flexibility may include suitably flexible metallic materials, carbon, carbon fiber, or flexible polymeric materials. A suitable polymeric material may include vinyl wrap, as one non-limiting example. Other polymeric materials may include polyester, polypropylene, or polyethylene, as further non-limiting examples.

The wrap 10 includes a two-dimensional perimeter shape configured to conform to the frustoconical three-dimensional shape of the ferrule 4 when received therearound and coupled (adhered) thereto. That is, the wrap 10 may be manufactured to include the necessary two-dimensional perimeter shape to correspond to a ferrule 4 of substantially any shape and configuration suitable for transitioning the shaft 3 to the hosel 2, including the use of alternative dimensions or slopes in comparison to the exemplary ferrule 4 shown in the present drawings. For example, different golf clubs may include variations in the shape and/or dimensions of the hosel 2 and the shaft 3 such that only certain ferrules 4 of corresponding shapes and/or dimensions may be appropriate for use in transitioning the corresponding features in a desired manner.

The wrap 10 according to the present invention is able to be manufactured to include substantially any two-dimensional shape necessary for closely covering the corresponding ferrule 4 when wrapped therearound, as explained hereinafter. The wrap 10 may be cut from a larger sheet of material comprising the described layers of the wrap 10 using a precision cutting process, such as a computer aided precision laser cutting process. Such a process may include the ability to prescribe the desired shape and dimensions of the two-dimensional outlay of the wrap 10 and to then automatically precision cut the desired two-dimensional shape within desired tolerances. The wrap 10 may accordingly be customizable to any ferrule shape or configuration in a quick and easy fashion via such a process. The formation of the wrap 10 including the backing layer 16 may include the wrap 10 being kiss cut or full cut into the corresponding sheet of layers, as desired, so long as the desired perimeter shape of the wrap 10 results when the adhesive layer 13 of the wrap 10 is exposed for coupling the wrap 10 to the golf club 1 following removal of the corresponding backing layer 16.

As shown in FIG. 1, the perimeter shape of the wrap 10 includes a first circumferential edge 21, a second circumferential edge 22, a first axial edge 23, and a second axial edge 24. When the wrap 10 is coupled to the ferrule 4 the first circumferential edge 21 is configured to extend circumferentially around the ferrule 4 at or adjacent the first axial end 6 thereof while the second circumferential edge 22 is configured to extend circumferentially around the ferrule 4 at or adjacent the second axial end 7 thereof. Additionally, the first axial edge 23 and the second axial edge 24 are configured to extend at least partially in the axial direction of the ferrule 4 while disposed at the same slope as the outer surface of the ferrule 4 between the opposing axial ends 6, 7 thereof when the wrap 10 is coupled to the ferrule 4. The circumferential edges 21, 22 may extend suitable respective distances in the circumferential direction to cause the axial edges 23, 24 to abut or partially overlap one another when the wrap 10 is wrapped around and fit to the outer surface of the ferrule 4.

When the wrap 10 is provided two-dimensionally, the first circumferential edge 21 is arcuate in shape and includes a first radius of curvature and the second circumferential edge 22 is arcuate in shape and includes a second radius of curvature that is less than the first radius of curvature. The first axial edge 23 extends rectilinearly and connects the circumferential edges 21, 22 at first ends thereof while the second axial edge 24 extends rectilinearly and connects the circumferential edges at second ends thereof. As should be understood by one skilled in the art, the two-dimensional configuration of the perimeter of the wrap 10 corresponding to the described edges 21, 22, 23, 24 may be determined by utilizing knowledge of the diameter of the first axial end 6 of the ferrule 4, the diameter of the second axial end 7 thereof, and the length of axial extension of the ferrule 4 between the opposing axial ends 6, 7 such that the wrap 10 is able to correspond to the frustoconical shape of the ferrule 4 when wrapped therearound.

The wrap 10 may further include at least one chamfered or beveled edge 25 at an intersection of a corresponding one of the circumferential edges 21, 22 and a corresponding one of the axial edges 23, 24. The edge 25 may be formed at the identified junction(s) to provide a feature for peeling or pulling the wrap 10 at the edge 25 more easily when the edge 25 is disposed at or adjacent a seam where the opposing axial edges 23, 24 meet or overlap one another when disposed along the ferrule 4. However, the wrap 10 may be provided in the absence of the one or more chamfered or beveled edges 25 while remaining within the scope of the present invention.

The wrap 10 may be dimensioned to engage different combinations of surfaces of the golf club 1 according to different implementations of the present invention. As shown in FIG. 6, the wrap 10 may be provided to include dimensions resulting in the wrap 10 corresponding substantially identically in shape and size to the frustoconical outer surface of the ferrule 4 such that the circumferential edges 21, 22 are disposed directly at the respective axial ends 6, 7 of the ferrule 4. As such, the wrap 10 may exclusively contact the exposed surfaces of the ferrule 4 when coupled to the golf club 1. Alternatively, as shown in FIG. 7, the wrap 10 may be provided to include an extension of the axial edges 23, 24 such that the first circumferential edge 21 is able to be disposed along the outer surface of the hosel 2 immediately adjacent and beyond the end thereof corresponding in position to the abutting first axial end 6 of the ferrule 4 while the second circumferential edge 22 is again disposed along the second axial end 7 of the ferrule 4. That is, the wrap 10 contacts both the ferrule 4 and a relatively small portion of the cylindrical end portion of the hosel 2. Although not pictured, it should be apparent that the wrap 10 may also be extended axially to extend at least partially over an exposed portion of the shaft 3 beyond the second axial end 7 of the ferrule 4, as desired, without necessarily departing from the scope of the present invention. The wrap 10 may also be offset axially inwardly relative to one or both of the axial ends 6, 7 of the ferrule 4, as desired, without necessarily departing from the scope of the present invention.

The wrap 10 may be utilized as follows. First, the user may need to remove the backing layer 16 from the wrap 10 to expose the adhesive layer 13 thereof. As shown in FIG. 5, the adhesive layer 13 is placed in facing relationship with the outer surface of the ferrule 4 and is aligned relative to the ferrule 4 for creating one of the covering configurations disclosed hereinabove with reference to FIGS. 6 and 7. Next, the user applies pressure to the outer exposed major surface 28 of the wrap 10, which may be formed by the base layer 12 or the cover layer 14 depending on the construction of the wrap 10, as the wrap 10 is engaged with and wrapped around the outer surface of the ferrule 4 to cause the adhesive layer 13 to adhere the wrap 10 to the ferrule 4 (and any other exposed surfaces of the golf club 1 in accordance with the selected covering configuration).

In some embodiments, the adhesive layer 13 may be provided to be removably or releaseably adhered to the ferrule 4 such that the wrap 10 may be removed and/or repositioned along the ferrule 4 while still maintaining desirable adhesion thereto. In other embodiments, the adhesive layer 13 may be provided to adhere to the ferrule 4 only a single instance or limited number of instances while maintaining the desired adhesion of the adhesive layer 13 following removal from the ferrule 4.

The user may position the wrap 10 at a preselected circumferential position along the ferrule 4 to result in the seam formed by the axial edges 23, 24 and/or any exposed graphics or other features of the wrap 10 having desirable circumferential positions corresponding to the desired application for which the wrap 10 is being utilized. For example, where the wrap 10 is provided primarily for ornamental purposes in covering the ferrule 4, the wrap 10 may be so positioned such that the seam is not normally perceptible and/or that the exposed graphics and/or other features of the wrap 10 are outwardly facing and easily identified during use of the golf club 1.

The golf ferrule wrap 10 as disclosed herein provides numerous advantageous features. The wrap 10 can be produced to have substantially any ornamental appearance as visually perceptible when viewing the outer exposed major surface 28 of the wrap 10 due to the ability to easily print graphics on a corresponding one of the layers 12, 14 forming the wrap 10, or otherwise apply surface features or the like to wrap 10. The appearance of the outer exposed major surface 28 may accordingly be customized according to the desires of the user of the wrap 10, including the ability of the user to select a digital file or the like for prescribing the graphics to be displayed on the outer exposed major surface 28 in accordance with the preferences of the user. That is, the appearance of the wrap 10 need not be selected from predetermined options, but may be customized to include graphics unique to each individual wrap 10, as desired. The wrap 10 may be formed from materials having certain visual characteristics that are not suitable for use in forming the ferrule 4 itself, hence the wrap 10 can be utilized in adding variety to the customizable appearance of the golf club 1. The wrap 10 is able to be appropriately sized to secure the ferrule 4 in the correct position relative to the remainder of the golf club 1 by adhering to both the ferrule 4 and the hosel 2 when utilizing a configuration such as that disclosed in FIG. 7. The manner of application of the wrap 10 to the golf club 1 also beneficially results in the customization of the appearance of the ferrule 4 absent the need to dismantle the golf club 1 and replace the ferrule 4. The wrap 10 protects and secures the ferrule 4 from external damage, including improving the durability of the ferrule 4 when striking an object and/or by preventing environmental variables to compromise the epoxy seating of the ferrule 4 to the golf club 1.

Referring now to FIG. 8, the wrap 10 may beneficially include the graphics displayed on the outer exposed major surface 28 thereof forming an optical code 30 capable of being externally sensed for determining additional information relating directly or indirectly to the golf club 1 to which the wrap 10 is coupled. The optical code 30 may be any visually identifiable code such as a QR code (pictured), a bar code, or the like, so long as the information encoded therein is able to be interpreted by the sensing mechanism for retrieving the desired information. As one example, the optical code 30 may be provided as a QR code that is able to be visually identified, read, and decoded by the corresponding features of a smart device such as a camera-equipped phone or tablet. The QR code may include information for redirecting the smart device to access a specific network location or web address having the information relating to the golf club 1, such as utilizing a web browser or similar application of the smart device to access a web page or similar graphical interface where the user of the smart device can view the information relating to the golf club 1. The use of the optical code 30 allows for a greater amount of information to be discovered regarding the golf club 1 via the redirection to the information digitally than would be possible when attempting to print such information directly onto the wrap 10.

The information relating to the golf club 1 may include information regarding various specifications or parameters of the golf club 1 corresponding to the operational use of the golf club 1, such as information relating to the dimensions, orientations, or material compositions of various components of the golf club 1 that may affect performance. The information relating to the golf club 1 may also include personal information relating to the owner/user of the golf club 1. Such information may be utilized to quickly and easily discover the proper owner of a misplaced golf club 1 and to return the golf club 1 thereto following a scanning of the corresponding optical code 30. Such personal information may include the name, address, or phone number of the owner of the golf club 1, as one example.

Referring now to FIG. 9, the wrap 10 may include a radio frequency identification (RDIF) tag 40 coupled to or otherwise embedded within the wrap 10. If the wrap 10 includes at least the base layer 12 and the cover layer 14, the RFID tag 40 may be disposed between the layers 12, 14 to embed the RFID tag 40 directly within the wrap 10. In other circumstances, an opening may be formed in the wrap 10 at the inner adhesive major surface 29 with the RFID tag 40 received within the wrap 10. However, the RFID tag 40 may be coupled to the wrap 10 using any method while remaining within the scope of the present invention.

The RFID tag 40 may be utilized to communicate the same information relating to the golf club 1 as described above. That is, an appropriate RFID reader device may interrogate the RFID tag 40 and trigger a response therefrom communicating the information regarding the golf club 1 digitally from the RFID tag 40 to the RFID reader device. This information can then be displayed by the RFID reader or may be utilized in redirecting the RFID reader to a specified web address or network location. The use of the RFID tag 40 may accordingly allow for the same discovery of information as is disclosed with regards to the optical code 30, but advantageously does not require a line of sight visual identification thereof. The RFID tag 40 may also be utilized in certain circumstances to track the physical location of the wrap 10 itself, thereby preventing the loss of misplacement of such golf clubs 1 having the wrap 10 coupled thereto. Such a tracking feature may require the use of an active RFID tag 40 having a battery associated therewith to allow for discovery of the RFID tag 40 at a distance.

FIG. 10 discloses the wrap 10 as having at least one weight 50 coupled to or otherwise embedded in the wrap 10. Each of the at least one weights 50 may be disposed between adjacent layers 12, 14 of the wrap 10 or coupled to the outer exposed major surface 28 or the inner adhesive major surface 29 of the wrap 10, as desired. Each of the at least one weights 50 may have any desired mass and corresponding weight value, including different weights 50 having the same or different weight values. The wrap 10 may include a distribution of a plurality of the weights 50 for providing a desired center of mass of the weights 50 relative to the remainder of the golf club 1. For example, the weights 50 are shown as being substantially equally distributed in the circumferential direction in FIG. 10 such that the weights 50 will be equally angularly spaced from one another around the circumferential direction of the ferrule 4 when the wrap 10 is coupled thereto. Such a configuration can be utilized to result in the center of mass (weight) of the weights 50 being positioned along the central axis of the shaft 3 when the weight value of each weight 50 is equal, as one example. The weights 50 are also shown as being disposed towards the circumferential edge of the wrap 10 disposed closer to the head of the golf club 1 to position the center of mass (weight) towards the club head and not towards the grip of the user. However, the illustrated example is not in any way limiting, as it should be readily apparent that the use of different positions of the weights 50 and different distributions of the weight value of each of the weights 50 may be utilized in locating the center of mass (weight) of the at least one weight 50 at substantially any position bounded by the wrap 10 around the shaft 3, including biasing the center of mass to be offset in any radial direction relative to the shaft 3 or in either axial direction relative to the shaft 3.

Alternatively to the use of weights 50, the wrap 10 may be formed from a flexible metallic material having a suitable density for adding a desired amount of mass (weight) to the golf club 1 at the position of the ferrule 4 in comparison to a carbon or polymeric material forming the wrap 10. The metallic material may form the entirety of the wrap 10 or may be utilized along only certain segments of the wrap 10 in combination with a relatively lighter material to once again result in a desired position of a center of mass resulting from the use of the relatively heavier metallic material at the corresponding distribution around the outer surface of the ferrule 4 both circumferentially and axially.

The use of the wrap 10 in adding weight to the golf club 1 provides numerous advantages. First, the ability to distribute the weights 50 or the flexible metallic material forming the wrap 10 around the ferrule 4 when the wrap 10 is coupled thereto allows for the center of mass to be positioned within the structural components of the golf club 1, such as within the shaft 3, absent the need to access this position within the golf club 1. The wrap 10 is also able to be easily removed and/or modified in comparison to a weight imbedded or otherwise non-removably coupled to the golf club 1, such as a weight disposed directly within the shaft 3 thereof, to allow for quick and easy adjustments of the weight distribution within the golf club 1.

Lastly, FIG. 11 shows the wrap 10 as including a tracking feature 60 disposed on the outer exposed major surface 28 thereof. The tracking feature 60 may refer to any detectable feature of the wrap 10 that may be utilized in detecting a position and/or orientation of the wrap 10 via an external sensor or camera. In the provided example, the tracking feature 60 is a highly reflective surface configured to reflect energy in a manner improving the detection of the tracking feature 60. The use of such a tracking feature 60 may be beneficial when the user of the golf club 1 wants to track certain aspects of the swing of the user, hence the need for the improved identification of the tracking feature 60 via the externally disposed sensor or camera. The tracking feature 60 may be utilized with respect to any type of electromagnetic wave and is not limited to visually detectable features. The tracking feature 60 is also not limited to especially reflective surfaces, and may refer to any identifiable feature, such as a certain shape or color displayed on the outer exposed major surface 28 of the wrap 10. The tracking feature 60 may be utilized by an external system as a means to easily track the metrics of the swing of the user of the wrap 10, such as by tracking the visually identifiable path of the wrap 10 during a swing, as well as additional parameters such as the velocity or acceleration of the wrap 10 during such a swing.

The wrap 10 is shown and described throughout as including the perimeter shape configured to correspond to the frustoconical shape of the ferrule 4 when wrapped therearound, but it should be apparent that several of the advantageous features of the present invention may be appreciated when the shape and size of the wrap 10 does not perfectly correspond to the outer surface of the ferrule 4, hence alternative perimeter shapes covering alternative portions of the ferrule 4 and/or hosel 2 may be utilized without necessarily departing from the scope of the present invention. For example, the wrap 10 may portray a desired ornamental appearance or may protect a desired surface or joint of the golf club 1 while not fully covering the ferrule 4, as desired.

The wrap 10 has been described throughout as being suitable for application to ferrule of a golf club, but the wrap 10 may be adapted for application to substantially any form of sports equipment having a similar construction where a shaft meets a head or similar operational tool. The wrap 10 may, for example, be adapted for application to the ferrule or analagous structure of a tennis racket, a billiards cue, a lacrosse stick, a fishing rod, or the like, as desired.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

The invention claimed is:

1. A wrap for a golf club having a hosel, a shaft received in the hosel, and a ferrule received over the shaft at a junction of the hosel and the shaft, the wrap comprising:

a flexible sheet defining an outer major surface and an inner major surface disposed opposite thereto, the outer major surface displaying a graphic thereon and the inner major surface adherable to a frustoconical outer surface of the ferrule, the flexible sheet having a two-dimensional perimeter including:

a first arcuate edge having a first radius of curvature corresponding to an outer diameter of a first axial end of the ferrule and an outer diameter of the hosel at a joint where the first axial end of the ferrule axially abuts an axial end of the hosel;

a second arcuate edge having a second radius of curvature corresponding to an outer diameter of a second axial end of the ferrule disposed adjacent an outer surface of the shaft;

a first connecting edge extending between a first end of the first arcuate edge and a first end of the second arcuate edge; and a second connecting edge extending between a second end of the first arcuate edge and a second end of the second arcuate edge;

wherein the first connecting edge and the second connecting edge each include a slope corresponding to a slope of the frustoconical outer surface of the ferrule and the two-dimensional perimeter of the flexible sheet is dimensioned in a manner wherein the inner major surface of the flexible sheet conforms to the frustoconical outer surface of the ferrule when the wrap is adhered thereto.

2. The wrap of claim 1, wherein the wrap is configured to cover an entirety of the frustoconical outer surface of the ferrule when the wrap is applied thereto.

3. The wrap of claim 1, wherein the wrap is configured to extend from a first axial end of the ferrule to an opposing second axial end thereof when the wrap is applied to the ferrule.

4. The wrap of claim 1, wherein the wrap is further adherable to a cylindrical outer surface of the hosel disposed immediately adjacent the joint where the first axial end of the ferrule axially abuts the axial end of the hosel, and wherein the wrap extending across the joint where the first axial end of the ferrule axially abuts the axial end of the hosel retains an axial position of the first axial end of the ferrule relative to the axial end of the hosel when the wrap is applied to the ferrule and the hosel.

5. The wrap of claim 1, wherein the wrap is dimensioned to extend from the first axial end of the ferrule to a position beyond the opposing second axial end thereof, the position beyond the second axial end of the ferrule disposed along a cylindrical outer surface of the hosel disposed immediately adjacent the joint where the first axial end of the ferrule axially abuts the axial end of the hosel when the wrap is applied to the ferrule and the hosel, wherein the wrap is adhered to both the ferrule and the hosel across the joint to prevent axial separation of the first axial end of the ferrule from the axial end of the hosel.

6. The wrap of claim 1, wherein the wrap is configured to exclusively cover the ferrule of the golf club.

7. The wrap of claim 1, wherein the wrap includes a seam where the first connecting edge of the flexible sheet abuts or overlaps the opposing second connecting edge thereof when the wrap is applied to the ferrule.

8. The wrap of claim 7, wherein a beveled edge is formed at an end of one of the first connecting edge or the second connecting edge of the flexible sheet.

9. The wrap of claim 1, wherein the flexible sheet comprises at least a base layer and an adhesive layer.

10. The wrap of claim 9, wherein the base layer is formed from one of a flexible polymeric material or a flexible carbon.

11. The wrap of claim 9, wherein the base layer is formed from a metallic material.

12. The wrap of claim 1, wherein the graphic is printed to be visible when viewing the outer major surface of the flexible sheet.

13. The wrap of claim 12, wherein the graphic is customized.

14. The wrap of claim 1, wherein the graphic includes an optical code disposed thereon.

15. The wrap of claim 1, wherein the graphic forms a tracking feature configured to be detected by an external sensor.

16. The wrap of claim 1, wherein the flexible sheet further includes:

a cover layer forming the outer major surface;

a base layer;

an adhesive layer disposed on the base layer and forming the inner major surface adherable to the frustoconical outer surface of the ferrule; and at least one weight element captured between the cover layer and the base layer, wherein the at least one weight element covers an area along the wrap that is not coextensive with an area covered by each of the base layer and the cover layer, and wherein a center of mass of the at least one weight element is disposed within a space bounded radially by a frustoconical shape of the outer major surface of the wrap and axially between opposing axial ends of the wrap when the inner major surface of the wrap is adhered to the frustoconical outer surface of the ferrule.

17. The wrap of claim 16, wherein the at least one weight element includes a plurality of the weight elements that are spaced apart from one another in one or both of the circumferential direction and the axial direction of the ferrule when the inner major surface of the wrap is adhered to the frustoconical outer surface of the ferrule to adjust the position of the center of mass of the plurality of the weight elements.

18. The wrap of claim 17, wherein a spacing of the plurality of the weight elements corresponds to the position of the center of mass of the plurality of the weight elements being offset from one or both of a central axis of the ferrule or a center of an axial dimension of the ferrule when the wrap is adhered to the frustoconical outer surface of the ferrule.

19. The wrap of claim 16, wherein the center of mass of the at least one weight element is offset from one or both of a central axis of the ferrule or a center of an axial dimension of the ferrule when the wrap is adhered to the frustoconical outer surface of the ferrule.

20. The wrap of claim 1, wherein the flexible sheet further includes:

a cover layer forming the outer major surface;

a base layer;

an adhesive layer disposed on the base layer and forming the inner major surface adherable to the frustoconical outer surface of the ferrule; and an RFID tag captured between the cover layer and the base layer, wherein the RFID tag is disposed within a space bounded radially by a frustoconical shape of the outer major surface of the wrap and axially between opposing axial ends of the wrap when the inner major surface of the wrap is adhered to the frustoconical outer surface of the ferrule, the RFID tag providing tracking data regarding a position of the ferrule of the golf club.

* * * * *